US008899093B2

(12) United States Patent
Beltrán de Nanclares Echezarreta et al.

(10) Patent No.: US 8,899,093 B2
(45) Date of Patent: Dec. 2, 2014

(54) DRAWING SUPPORT FOR A SHEET METAL DRAWING MACHINE

(75) Inventors: Eduardo Beltrán de Nanclares Echezarreta, Vitoria-Gasteiz (ES); David Chico García, Vitoria-Gasteiz (ES); Oscar González Mora, Donostia-San Sebastian (ES); Daniel García Cheuca, Donostia-San Sebastian (ES)

(73) Assignee: Fagor, S. Coop, Mondragon (ES)

( * ) Notice: Subject to any disclaimer, the term of this patent is extended or adjusted under 35 U.S.C. 154(b) by 741 days.

(21) Appl. No.: 12/961,353

(22) Filed: Dec. 6, 2010

(65) Prior Publication Data

US 2011/0132062 A1 Jun. 9, 2011

(30) Foreign Application Priority Data

Dec. 4, 2009 (ES) ..... 200931123

(51) Int. Cl.
*B21D 37/12* (2006.01)
*B21D 25/00* (2006.01)
*B21D 1/00* (2006.01)

(52) U.S. Cl.
CPC . *B21D 25/00* (2013.01); *B21D 1/00* (2013.01)
USPC ..... 72/455; 72/302; 72/465.1

(58) Field of Classification Search
USPC ..... 72/274, 281, 343, 446, 448, 455, 467, 72/465.1, 456, 470, 302, 311; 100/214
See application file for complete search history.

(56) References Cited

U.S. PATENT DOCUMENTS

| | | | | |
|---|---|---|---|---|
| 2,737,138 | A * | 3/1956 | Derbyshire | 72/60 |
| 3,230,754 | A * | 1/1966 | Arbogast | 72/316 |
| 3,353,397 | A * | 11/1967 | Hoffmann | 72/455 |
| 3,508,430 | A * | 4/1970 | Edmondson | 72/456 |
| 3,621,703 | A * | 11/1971 | Swift | 72/455 |
| 3,673,667 | A * | 7/1972 | Loewenstein et al. | 29/423 |
| 3,743,463 | A * | 7/1973 | Patrick et al. | 425/195 |

(Continued)

FOREIGN PATENT DOCUMENTS

| | | |
|---|---|---|
| DE | 4437872 C1 | 3/1996 |
| EP | 1923150 A1 | 5/2008 |

(Continued)

OTHER PUBLICATIONS

Report on the State of the Art for National Patent Application No. 200931122 issued by the Spanish Office of Patents and Trademarks, dated Mar. 14, 2012, pp. 1-5.

(Continued)

*Primary Examiner* — Edward Tolan
(74) *Attorney, Agent, or Firm* — Tim L. Kitchen; Peter B. Scull; Hamilton DeSanctis & Cha, LLP

(57) ABSTRACT

A drawing support for a metal sheet drawing machine. In one implementation the drawing support is constructed of a plurality of plates positioned in series one after the other and coupled together so that at least a portion of the plurality of plates are compressed one against the other. In one implementation each of the plurality of plates has a window through which metal sheet to be drawn may pass, and a holder for holding the metal sheet when it is drawn.

17 Claims, 2 Drawing Sheets

(56) References Cited

U.S. PATENT DOCUMENTS

| | | | | | |
|---|---|---|---|---|---|
| 4,207,048 | A | * | 6/1980 | Seymour | 425/151 |
| 4,248,079 | A | | 2/1981 | Specktor | |
| 4,375,785 | A | * | 3/1983 | Schoch et al. | 100/35 |
| 4,751,838 | A | | 6/1988 | Voges | |
| 4,805,440 | A | * | 2/1989 | Lenders | 72/455 |
| 5,272,905 | A | * | 12/1993 | Parlow et al. | 72/466 |
| 5,878,619 | A | * | 3/1999 | Walczak | 72/478 |
| 5,966,976 | A | * | 10/1999 | Haraga | 72/57 |
| 6,000,271 | A | * | 12/1999 | Olsson et al. | 72/448 |
| 6,205,830 | B1 | | 3/2001 | Voges | |
| 6,865,984 | B2 | * | 3/2005 | Schurmann et al. | 100/35 |
| 2008/0034827 | A1 | | 2/2008 | Casal et al. | |
| 2009/0308131 | A1 | * | 12/2009 | Boers | 72/384 |

FOREIGN PATENT DOCUMENTS

| | | | | | |
|---|---|---|---|---|---|
| GB | 1172243 | A | | 11/1969 | |
| GB | 2446921 | A | | 8/2008 | |
| JP | 58-35099 | A | * | 1/1983 | B30B 15/04 |

OTHER PUBLICATIONS

Report on the State of the Art for National Patent Application No. 200931121 issued by the Spanish Office of Patents and Trademarks, dated Mar. 14, 2012, pp. 1-5.

Report on the State of the Art for National Patent Application No. 200931123 issued by the Spanish Office of Patents and Trademarks, dated Apr. 18, 2012, pp. 1-4.

* cited by examiner

DRAWING SUPPORT FOR A SHEET METAL DRAWING MACHINE

CROSS-REFERENCE TO RELATED APPLICATIONS

This application relates to and claims the benefit and priority to Spanish Patent Application P200931123, filed Dec. 4, 2009.

TECHNICAL FIELD

The invention relates to machines for drawing metal sheet, and more specifically to the drawing supports used in these types of machine. The invention also relates to procedures for the manufacture of drawing supports.

BACKGROUND

Metal sheet used in industry to create different-shaped pieces by means of, for example, pressing, stamping or forming is provided in the form of rolls or coils of metal. The coils must be uncoiled in order for the metal sheet to be handled and when this is done the sheet features undulations and distortions that are detrimental to its subsequent treatment or handling. In order to solve this drawback the sheet to be unrolled must be handled by a straightening machine where most of the stresses are eliminated. These straightening machines generally comprise a plurality of rollers between which the sheet passes.

This process is suitable for cases in which the sheets comprise a limited thickness. If the thickness exceeds a certain value, the rollers required to eliminate the stresses are very large, making the elimination of stresses in this way difficult. In these cases a drawing machine such as the one disclosed in document EP1923150A1 may be used, by means of which the sheet is drawn to eliminate the stresses. This method can also be used for sheets of limited thickness. A drawing machine generally comprises a fixed support and a moving support that moves in relation to the fixed support in a drawing process. Both supports comprise a window through which the metal sheet to be drawn passes, and a holder for holding the metal sheet during the process with the aim of ensuring it is drawn. During the process of drawing metal sheet, due to the forces generated by the holder and the tension of the metal sheet, the supports suffer deformations that weaken them over time.

SUMMARY OF THE DISCLOSURE

A drawing support for a metal sheet drawing machine is provided. In one implementation the drawing support is constructed of a plurality of plates positioned in series one after the other and coupled together so that at least a portion of the plurality of plates are compressed one against the other. In one implementation each of the plurality of plates has a window through which metal sheet to be drawn may pass. In one implementation features among the plurality of plates facilitate the incorporation of a holder within the drawing support for holding the metal sheet when it is drawn.

In one implementation the drawing support is formed by a plurality of plates, each plate comprising a window through which metal sheet to be drawn passes. The plates are disposed one after the other, and are connected together with the result that they are bound to each other, the plates forming a compact block that corresponds to the drawing support.

As a result, according to some implementations the plates that form the drawing support are compressed and comprise a width smaller than their original or natural width. When the metal sheet is drawn the plates are deformed in a direction that decompresses them, with the result that they tend to recover their natural width or shape. If the deformation is insufficient to attain the natural position, the plates barely suffer as they are less tense than they would be if they were compressed. If the deformation is greater than that necessary for the plates to reach their natural position, the plates are only affected by deformation exceeding their natural position. This thus reduces the effect of deformation on the drawing support caused by the drawing of metal sheet, thereby increasing its useful life.

According to one implementation a drawing support for a metal sheet drawing machine suitable for incorporating therein a holder that functions to support a metal sheet in the drawing support during a drawing process is provided, the drawing support comprising a plurality of plates positioned in series one after another, the plurality of plates comprising a first end plate having an inner face and an outer face, a second end plate having an inner face and an outer face, and intermediary plates disposed between the inner faces of the first and second end plates, each of the plurality of plates having a window through which a metal sheet to be drawn may pass and a plurality of connecting through holes, at least a portion of the plurality of plates being held together by compression inducing members that extend through the connecting through holes of the at least portion of the plurality of plates, the compression inducing members binding the at least portion of the plurality of plates to cause the at least portion of the plurality of plates to be in a compressed state.

According to one implementation a drawing support for a metal sheet drawing machine suitable for incorporating therein a holder that functions to support a metal sheet in the drawing support during a drawing process is provided, the drawing support comprising a plurality of plates positioned in series one after another, the plurality of plates comprising a first end plate having an inner face and an outer face, a second end plate having an inner face and an outer face, and intermediary plates disposed between the inner faces of the first and second end plates, each of the plurality of plates having a window through which a metal sheet to be drawn may pass and a plurality of connecting through holes, the plurality of plates arranged so that respective connecting through holes of adjacent plates are commonly aligned, the plurality of plates being held together in a compressed state by compression inducing members that extend through the connecting through holes.

According to one implementation a drawing support is provide that further comprises a first connecting sheet connected to the outer face of the first end plate and a second connecting sheet connected to the outer face of the second end plate, each of the first and second connecting sheets having through holes commonly aligned with at least some of the plurality of connecting through holes in the respective first and second end plates, each of the compression inducing members comprising a shank that extends between first and second abutment members, the shanks of the compression inducing members extending through the through holes of the first and second connecting sheets and being supported by the through holes in a manner that inhibits the compression inducing members from contacting the inner surfaces that delimit the connecting through holes of the plurality of plates, the first and second abutment members acting on an outer surface of the first and second connecting sheets, respectively, to cause the plurality of plates to be held together in the compressed state.

According to one implementation a method for the manufacture of a drawing support for a metal sheet drawing machine is provided, the method comprising: arranging a plurality of plates that each have windows through which a metal sheet to be drawn may pass so that the plurality of plates are disposed in series one after another and so that the windows of the plurality of plates are commonly aligned; and coupling together the plurality of plates so that at least a portion of the plurality of plates are compressed one against another.

According to one implementation a method for the manufacture of a drawing support for a metal sheet drawing machine is provided, the method comprising: forming a plurality of plates with each plate having a window through which a metal sheet to be drawn may pass, arranging the plurality of plates in series one after another so that the windows of the plurality of plates are commonly aligned; and coupling together the plurality of plates in a manner that results in at least a portion of the plurality of plates to be compressed one against another.

These and other advantages and characteristics of the invention will be made evident in the light of the drawings and the detailed description thereof.

DETAILED DESCRIPTION

Figure 1:
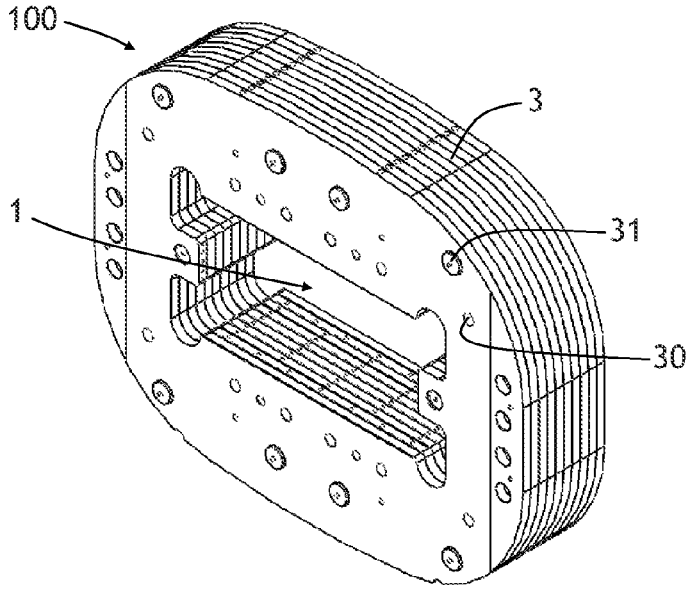
FIG. 1 illustrates a perspective view of a drawing support according to one implementation.

FIG. 1 illustrates an implementation of a drawing support 100 for use in a metal sheet drawing machine. In the implementation of FIG. 1, the drawing support 100 comprises a window 1 through which a metal sheet (not shown) to be drawn passes. Although not shown, the drawing support 100 also includes features that permit a holder to be incorporated therewith for holding the metal sheet within the window 1 while the metal sheet is being drawn.

Figure 2:
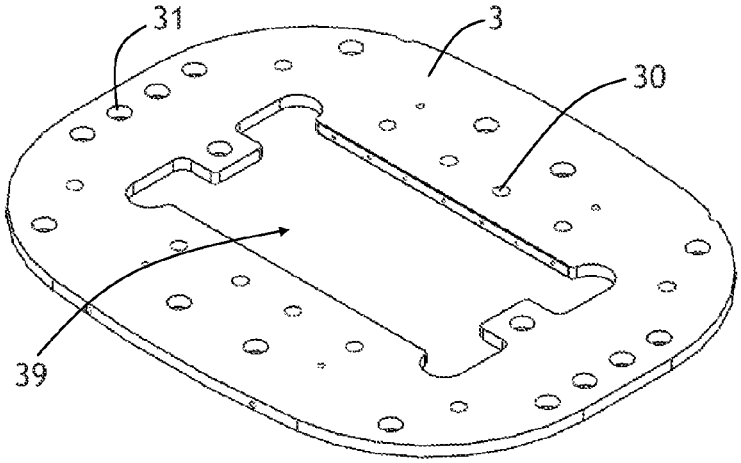
FIG. 2 illustrates a perspective view of an exemplary plate of a drawing support in one implementation.
Figure 3:
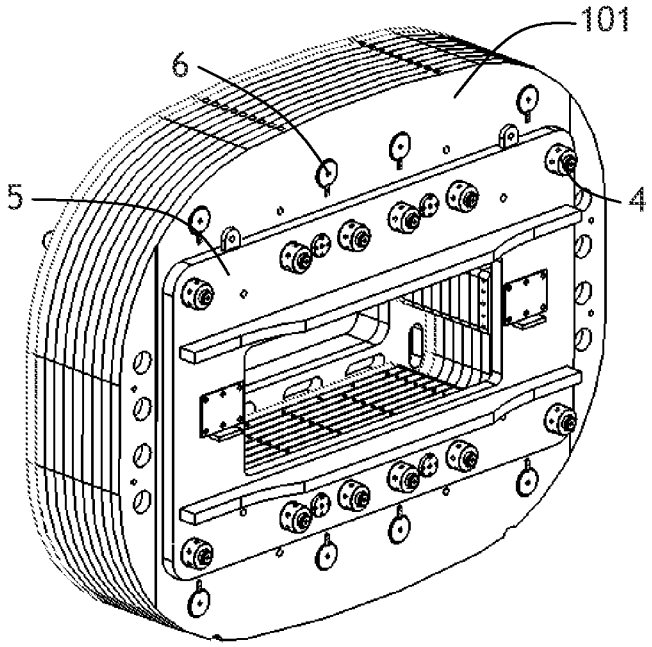
FIG. 3 illustrates a perspective view of a drawing support according to one implementation

In one implementation the drawing support 100 is formed by a plurality of longitudinal plates 3 with each plate 3 having a window 39 through which a metal sheet to be drawn passes. FIG. 2 illustrates an example of a plate 3. The plates 3 are disposed one after the other and are bound to each other, the plates 3 forming a compact block that corresponds to the drawing support 100. In one implementation the plates 3 are made of steel or a steel alloy. In one implementation each of the plates 3 have the same or similar thickness.

In one implementation each plate 3 also has a plurality of connecting through holes 30 that are aligned with respective connecting through holes 30 of the other plates 3 to enable the plates 3 to be connected together when the plates 3 are disposed one after the other. In one implementation the drawing support 100 includes braces or compression inducing members 4 to pass through each row of connecting holes 30 formed by an alignment of connecting holes 30 of the different plates 3 when some are disposed after others, so that the braces 4 bind at least some of the plates 3 in relation to the others, connecting the plates 3 together with the result that they are compressed, the unit of compressed plates 3 corresponding to the drawing support 100.

When metal sheet is drawn by means of the drawing support 100, the drawing support 100 supports forces generated by the holder and by the tension of the metal sheet, and is deformed in a direction in which its width increases. In the drawing support 100, given that it is formed by compressed plates 3, the direction translates into a direction in which the plates 3 are decompressed, so that the plates 3 tend to recover their natural width or shape. If the deformation is insufficient to attain the natural width, the plates 3 barely suffer as they are less tense than they would be if they were compressed. If the deformation is greater than that necessary for the plates 3 to reach their natural width, the plates 3 are only affected by deformation exceeding their natural width. As a result of being formed by compressed plates 3, the effect of the deformation caused on the drawing support 100 during the drawing of metal sheet is reduced, thereby increasing its useful life.

In one implementation the connecting holes 30 comprise a larger diameter than the braces 4 and the braces are disposed in the connecting holes 30 without coming into contact with the surfaces that delimit the connecting holes 30, so that a possible deformation of the plates 3 (compression or decompression) does not impact on the braces 4 and, therefore, does not impact on the connection. To ensure that the braces 4 do not come into contact with the surfaces delimiting the connecting holes 30, in one implementation the drawing support 100 comprises a connecting sheet 5 disposed on each of its outer faces 101, each connecting sheet 5 comprising through holes aligned with each, or at least some, of the connecting holes 30 formed by the plates 3, when some are disposed after others, the braces 4 passing through the holes to compress the plates 3 and connect them together. In one implementation the braces 4 are supported on the connecting sheets 5 and acts directly on the connecting sheets 5 to bind the plates 3 to each other.

In one implementation the plates 3 also comprise a plurality of positioning through holes 31 that are aligned with respective positioning through holes 31 of the other plates 3 to enable the alignment of the plates 3 with each other. In one implementation the drawing support 100 comprises a pin or elongate member 6 to pass through the rows of positioning holes 31 formed by an alignment of positioning holes 31 of the different plates 3, when they are disposed one after the other, so by means of the positioning holes 31 and the respective elongate members 6 the plates 3 are aligned with each other when they are disposed one after the other, prepared to be connected together by means, for example, of braces 4. The drawing support 100 may comprise as many positioning holes 31 as considered necessary, and the pins may be removed once the plates 3 have been bound or may remain in the drawing support 100.

A procedure for the manufacture of a drawing support 100 for a metal sheet drawing machine, such as the one described above, is detailed below. According to one implementation the procedure comprises a manufacturing step in which a plurality of plates 3 is manufactured or otherwise acquired. In one implementation the plates are formed using a conventional procedure, such as oxygen cutting. In some implementations the respective windows 39 and/or connecting through holes 30 and/or positioning holes 31 are formed by means of the same procedure and at the same time or at a different time.

In one implementation an alignment step is performed prior to coupling the plates 3 together and in which the plates 3 are disposed one after the other with the result that the connecting holes and the fixing holes 31 are aligned, and a pin 6 is inserted, which passes through each row formed by positioning holes 31 to ensure this alignment (this may also be of use during the arrangement of the plates 3 in order to align them).

In one implementation a connection step is carried out and in which the plates 3 are bound to each other or compressed together, the plates 3 forming a block that corresponds to the drawing support 100. The connection step may be carried out in a variety of manners including, but not limited to welding, the use of fasteners, such as braces 4, etc. In one implementation the connection step comprises positioning compression inducing members 4 within a plurality of the serially aligned connecting through holes 30 of the plates 3. In one implementation a connecting sheet 5 with through holes is positioned on each of the outer faces 101 of the drawing support 100. In one implementation compression inducing members 4 are positioned to pass through the connecting holes 30 and the respective through holes of the connecting sheets with the result that the compression inducing members 4 exert a direct action on the connecting sheets 5 compressing them together, the plates 3 thus being connected together in a compact manner.

What is claimed is:

1. A drawing support for a metal sheet drawing machine incorporating therein a holder that functions to supply a force to support a metal sheet in the drawing support while tension is applied to the metal sheet during a drawing process, the drawing support comprising a plurality of plates with each plate having a window through which the metal sheet to be drawn may pass, the plurality of plates positioned in series one after another with the windows of adjoining plates being aligned with one another, at least a portion of the plurality of plates being coupled together in a manner that causes the at least portion of the plurality of plates to be in a compressed state, each of the at least portion of the plurality of plates having a natural width when not in the compressed state and having a second width less than the natural width when in the compressed state, each of the at least portion of the plurality of plates configured to deform in a direction that decompresses the plates and to cause the plates to expand from the second width toward the natural width in response to the holder supplying the force to support the metal sheet during the drawing process and configured to return to the compressed state when the holder ceases to supply the force to support the metal sheet.

2. A drawing support according to claim 1, wherein the plurality of plates are positioned in series one against another.

3. A drawing support according to claim 1, wherein the at least portion of the plurality of plates comprises all of the plurality of plates.

4. A drawing support according to claim 1, wherein the plurality of plates are positioned in series one against another and the at least portion of the plurality of plates comprises all of the plurality of plates.

5. A metal sheet drawing machine comprising a drawing support according to claim 1.

6. A drawing support for a metal sheet drawing machine incorporating therein a holder that functions to supply a force to support a metal sheet in the drawing support while tension is applied to the metal sheet during a drawing process, the drawing support comprising a plurality of plates positioned in series one after another, the plurality of plates comprising a first end plate having an inner face and an outer face, a second end plate having an inner face and an outer face, and intermediary plates disposed between the inner faces of the first and second end plates, each of the plurality of plates having a window through which the metal sheet to be drawn may pass and a plurality of connecting through holes, at least a portion of the plurality of plates being held together by compression inducing members that extend through the connecting through holes of the at least portion of the plurality of plates, the compression inducing members binding the at least portion of the plurality of plates to cause the at least portion of the plurality of plates to be in a compressed state, each of the at least portion of the plurality of plates having a natural width when not in the compressed state and having a second width less than the natural width when in the compressed state, each of the at least portion of the plurality of plates configured to deform in a direction that decompresses the plates and to cause the plates to expand from the second width toward the natural width in response to the holder supplying the force to support the metal sheet during the drawing process and configured to return to the compressed state when the holder ceases supply the force to support the metal sheet.

7. A drawing support according to claim 6, wherein the plurality of plates are positioned in series one against another.

8. A drawing support according to claim 6, wherein the at least portion of the plurality of plates comprises all of the plurality of plates.

9. A drawing support according to claim 6, wherein the plurality of plates are positioned in series one against another and the at least portion of the plurality of plates comprises all of the plurality of plates.

10. A drawing support according to claim 6, wherein the compression inducing members are positioned within at least a portion of the connecting through holes without contacting the inner surfaces that delimit the at least portion of connecting through holes.

11. A drawing support according to claim 6, wherein the compression inducing members are positioned within the connecting through holes without contacting the inner surfaces that delimit the connecting through holes.

12. A drawing support according to claim 6, wherein the plurality of plates further comprises a plurality of positioning through holes which are aligned with respective positioning through holes of the other plates to enable the alignment of the plurality of plates with each other by the insertion of elongate members into the plurality of positioning holes during an assembling of the plates together.

13. A drawing support according to claim 6, wherein the plurality of plates are made of steel.

14. A metal sheet drawing machine comprising a drawing support according to claim 6.

15. A drawing support for a metal sheet drawing machine suitable for incorporating therein a holder that functions to supply a force to support a metal sheet in the drawing support while tension is applied to the metal sheet during a drawing process, the drawing support comprising a plurality of plates positioned in series one after another, the plurality of plates comprising a first end plate having an inner face and an outer face, a second end plate having an inner face and an outer face, and intermediary plates disposed between the inner faces of the first and second end plates, each of the plurality of plates having a window through which a metal sheet to be drawn may pass and a plurality of connecting through holes, the plurality of plates arranged so that respective connecting through holes of adjacent plates are commonly aligned, the plurality of plates being held together in a compressed state by compression inducing members that extend through the connecting through holes, the drawing support further comprising a first connecting sheet connected to the outer face of the first end plate and a second connecting sheet connected to the outer face of the second end plate, each of the first and second connecting sheets having inner and outer faces and through holes that are commonly aligned with at least some of the plurality of connecting through holes in the respective first and second end plates, each of the compression inducing members comprising a shank that extends between first and second abutment members that abut the outer faces of the first and second connecting sheets, respectively, the compression inducing members being supported by the first and second connecting sheets so that the shanks of the compression inducing members are inhibited from applying a force to the inner surfaces that delimit the connecting through holes of the plurality of plates, the first and second abutment members acting on the outer face of the first and second connecting sheets, respectively, to cause the plurality of plates to be held together in the compressed state.

16. A drawing support according to claim 15, wherein the plurality of plates further comprises a plurality of positioning through holes which are aligned with respective positioning through holes of the other plates to enable the alignment of the plurality of plates with each other by the insertion of elongate members into the plurality of positioning holes during an assembling of the plates together.

17. A drawing support according to claim 15, wherein the plurality of plates are made of a steel or steel alloy.

* * * * *